US010918900B2

(12) United States Patent
Anaya

(10) Patent No.: US 10,918,900 B2
(45) Date of Patent: Feb. 16, 2021

(54) RESISTANCE BAND WITH INNER WIRE CORE

(71) Applicant: Python Fitness, LLC, Riviera Beach, FL (US)

(72) Inventor: Richard Anaya, Palm Beach Gardens, FL (US)

(73) Assignee: Python Fitness, LLC, Riviera Beach, FL (US)

( * ) Notice: Subject to any disclaimer, the term of this patent is extended or adjusted under 35 U.S.C. 154(b) by 73 days.

(21) Appl. No.: 16/034,932

(22) Filed: Jul. 13, 2018

(65) Prior Publication Data

US 2019/0160323 A1 May 30, 2019

Related U.S. Application Data

(60) Provisional application No. 62/591,466, filed on Nov. 28, 2017.

(51) Int. Cl.

| | |
|---|---|
| ***A63B 21/055*** | (2006.01) |
| ***A63B 21/00*** | (2006.01) |
| ***A63B 21/04*** | (2006.01) |

(52) U.S. Cl.

CPC .... *A63B 21/0555* (2013.01); *A63B 21/00189* (2013.01); *A63B 21/0442* (2013.01); *A63B 21/0557* (2013.01); *A63B 21/4035* (2015.10)

(58) Field of Classification Search

CPC ..... A63B 21/00189; A63B 21/0442; A63B 21/0555; A63B 21/0557; A63B 21/4035

See application file for complete search history.

(56) References Cited

U.S. PATENT DOCUMENTS

| | | | | |
|---|---|---|---|---|
| 5,263,916 | A | 11/1993 | Bobich | |
| 5,590,422 | A * | 1/1997 | Henderson | A41D 20/00 2/171 |
| 5,978,964 | A * | 11/1999 | Gaston | A63B 21/065 2/228 |
| 2014/0113777 | A1* | 4/2014 | Pahl | A63B 23/12 482/93 |
| 2018/0250555 | A1* | 9/2018 | Dean | A63B 26/003 |
| 2018/0256934 | A1* | 9/2018 | Ciccarone | A63B 60/02 |
| 2018/0256935 | A1* | 9/2018 | Ciccarone | A63B 21/00 |

* cited by examiner

*Primary Examiner* — Megan Anderson

(74) *Attorney, Agent, or Firm* — McHale & Slavin, P.A.

(57) ABSTRACT

An elastic, resistance band type exercise or training device which provides a user the ability to attach or secure to various objects without the need of specific attachment devices. The elastic, resistance band type exercise or training device may comprise an outer resistance band made of an elastic or stretchable material and an inner flexible member configured to change its shape, but not stretch, when a force is applied, and maintain the changed shape until a second force is applied. The inner flexible member may be coaxially aligned with said outer resistance band. The outer resistance band may have an interior region and a length. The inner flexible member may have a length that is at least less than the length of the outer resistance band, thereby forming a resistance exercise portion and an attachment portion.

17 Claims, 7 Drawing Sheets

RESISTANCE BAND WITH INNER WIRE CORE

CROSS REFERENCE TO RELATED APPLICATIONS

In accordance with 37 C.F.R. 1.76, a claim of priority is included in an Application Data Sheet filed concurrently herewith. Accordingly, the present invention claims priority to U.S. Provisional Application No. 62/591,466, entitled, "A Resistance Band With Inner Wire Core Allowing for Multiple Attachment Methods by Wrapping Around a Suitably Secure Object Such as a Small Tree, Pole, Gym Equipment, etc.", filed Nov. 28, 2017. The contents of the above referenced application are incorporated herein by reference in their entirety.

FIELD OF THE INVENTION

This invention relates generally to exercise equipment; to personal training devices comprising of an elastic member; and more particularly, to a personal training device comprising an elastic resistance band configured for attaching to various objects, thus providing a user the ability to maximize the use of the resistance band for strength training exercises by attaching to various objects without the need of specific attachment devices.

BACKGROUND OF THE INVENTION

Use of personal training devices comprising elastic members, such as resistance bands, is a popular tool for strength training and use in rehabilitation techniques. Given their light weight and versatility, resistance bands provide users an alternative to the expensive, large and numerous pieces of equipment associated with free weight systems and expensive gym memberships. In addition, because resistance bands can be portable, a user can perform exercises in virtually any location. The typical elastic member has a central elongated resilient element with a means to attach to a specific object, such as a wrist attachment strap at one end and a foot attachment strap at the other end. U.S. Pat. No. 5,263,916 discloses a typical resistance style exercise equipment having specific object attachment means. The device disclosed contains a wrist attachment strap at one end, and a foot attachment strap at the other end.

One of the common problems associated with the use of elastic members is the need for a secondary component to secure to an object. By including attachment means at each end, the typical elastic member is limited to the type of object it can be attached to. To overcome such shortcomings, an elastic member type resistance exercise device that can quickly and easily, without the need of specific attachment means, be secured and unsecured to various objects is needed.

SUMMARY OF THE INVENTION

The present invention relates to an elastic, resistance band type exercise or training device which provides a user the ability to attach or secure to various objects without the need of specific attachment devices. In one embodiment, a resistance exercise band comprises a resistance band body comprising an elastic or stretchable material, the resistance band body comprising a first proximal end and second distal end and an inner flexible member positioned at least at the distal end.

In another embodiment, the elastic, resistance band type exercise or training device may comprise an outer resistance band made of an elastic or stretchable material, and comprise an inner region and length; and an inner flexible member configured to change its shape, but not stretch, when a force is applied, and maintain the changed shape until a second force is applied. The inner flexible member is coaxially aligned with the outer resistance band. The inner flexible member has a length that is at least less than the length of the outer resistance band, thereby forming a resistance exercise portion and an attachment portion.

Accordingly, it is an objective of the invention to provide exercise equipment.

It is a further objective of the invention to provide a resistance band.

It is yet another objective of the invention to provide a resistance band that is configured to easily attach to an object.

It is a still further objective of the invention to provide a resistance band that is configured to quickly attach to an object.

It is a further objective of the invention to provide a resistance band that is configured to easily and quickly attach to an object without the need of additional components, such as straps or mounts.

It is yet another objective of the invention to provide a resistance band that can attach to an object at multiple locations.

It is a still further objective of the invention to provide a resistance band that can attach to an object at multiple locations without the need of having or using specific attachment devices.

It is a further objective of the invention to provide a resistance band that comprises an inner flexible member that can be manipulated to secure to various objects.

It is yet another objective of the invention to provide a resistance band that comprises an inner flexible member that can be manipulated to secure to various objects without the need of having or using specific attachment devices.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
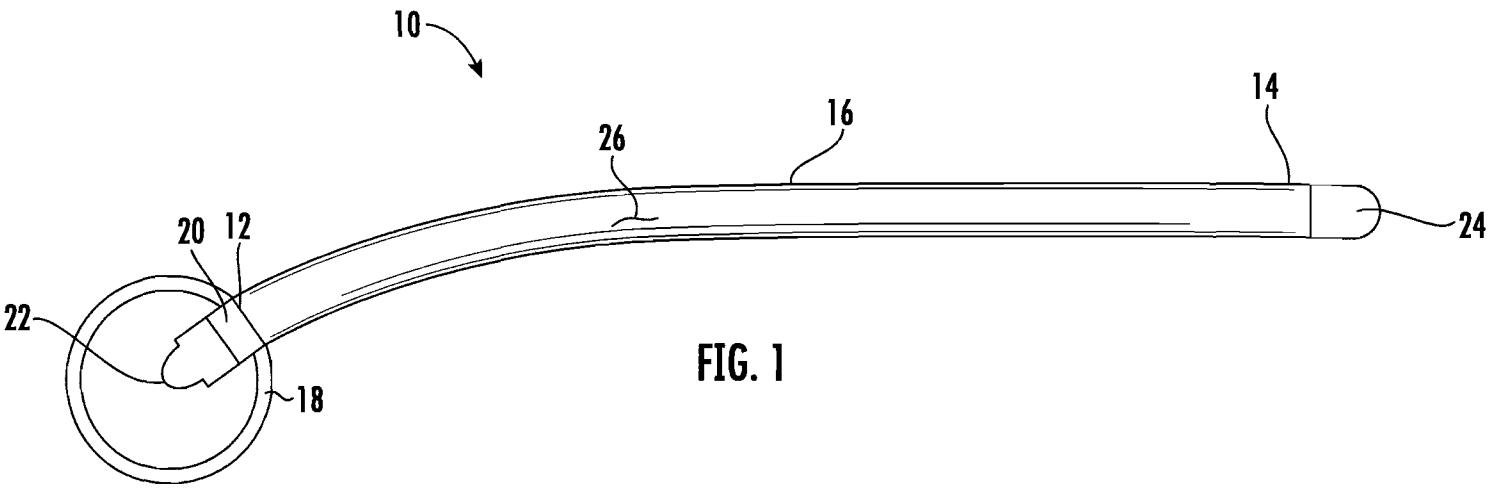
FIG. 1 is a perspective view of an illustrative embodiment of the resistance band.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIG. 1, an embodiment of a resistance band configured for attachment to various objects, referred to generally as resistance band 10, is illustrated. The resistance band 10 comprises a first or proximal end 12 (end closest to the user when used), a second opposing or distal end 14 (end furthest from the user when in use or the end which attaches to an object when in use), and a main body 16 therebetween. The main body 16 is illustrated having an elongated, generally tubular shape. The proximal end 12 may include a gripping or holding member, illustrated herein as a handle 18 attached or secured to the main body 16 via a grommet 20 and grommet stop 22. The handle 18 is sized and shaped to receive one or more portions of a user's hand, such as fingers and palm, providing the user mechanism to grip or hold the handle 18 when performing an exercise movement. The handle 18 may be made of natural or synthetic material, such as a nylon fabric or a plastic material. The handle 18 may be replaced by a strap or other attachment anchors. The distal end 14 may include a cap 24.

Figure 2:
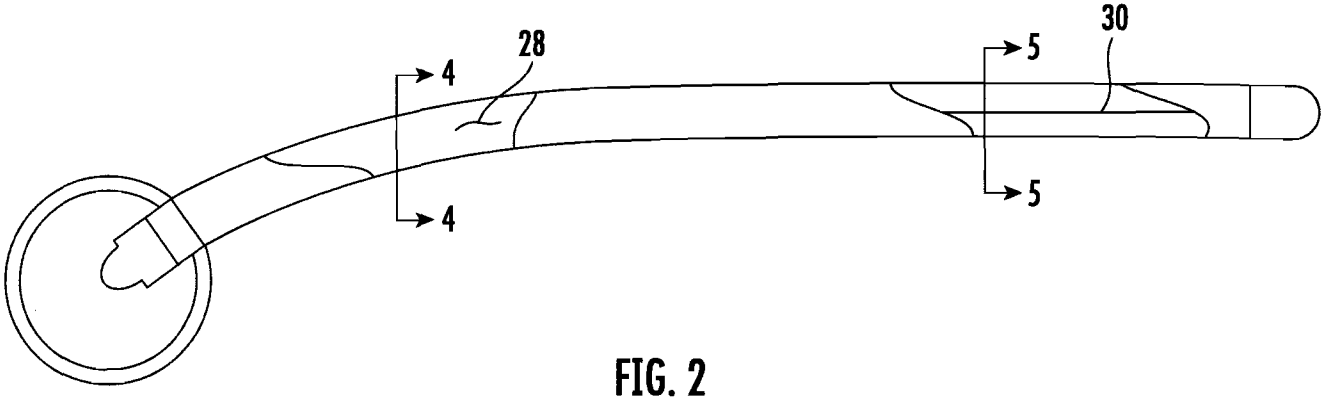
FIG. 2 is a perspective view of the resistance band, shown with partial cut out portions.
Figure 3:
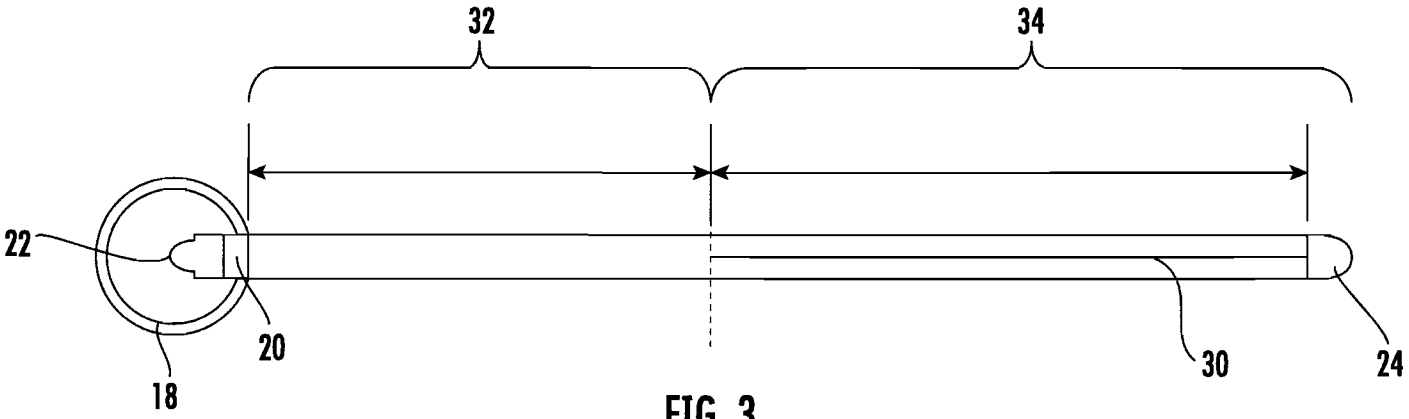
FIG. 3 is a cross sectional view of the resistance band.
Figure 5:
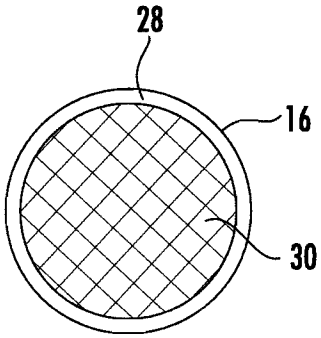
FIG. 5 is a cross-sectional view of the resistance band taken along lines 5-5 in FIG. 2, illustrating the attachment portion.
Figure 4:
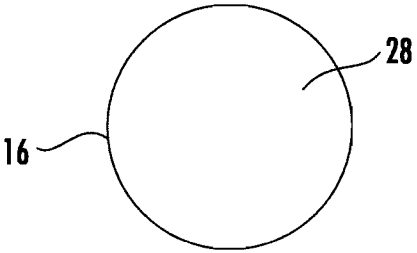
FIG. 4 is a cross-sectional view of the resistance band taken along lines 4-4 in FIG. 2, illustrating the resistance exercise portion.

The main body 16 comprises an outer surface 26 and an interior region 28, see FIG. 2. The interior region 28 may be hollow. Preferably, the main body 16 is made of an elastic or stretchable material, such as a rubber, including a latex rubber, particularly non-vulcanized rubber, silicone, or any other appropriate material. The stretchable material may be configured to have different elastic or stretching characteristics in order to provide different resistances when pulled, i.e. provide 1 or 2 pounds of resistance when pulled, 5 pounds of resistance when pulled, 10 pounds of resistance when pulled, or greater than 10 pounds of resistance when pulled. At least some portion of the interior region 28 of the main body 16 may comprise a flexible member 30 so that the resistance band 10 may be divided into a resistance exercise portion 32, portion where there is no flexible member, and an attachment portion 34 having the flexible member therein. Preferably, the flexible member 30 is fixed in place and does not move within the interior region of the main body 16. FIG. 4 is a cross-sectional view, taken along lines 4-4 of FIG. 2, illustrating the resistance exercise portion in which there is no flexible member 30. The interior region 28 is empty or hollow. FIG. 5 is a cross-sectional view taken along lines 5-5 of Figure of FIG. 2, illustrating the attachment portion 34 portion in which the interior region 28 comprises the flexible member 30.

Figure 6:
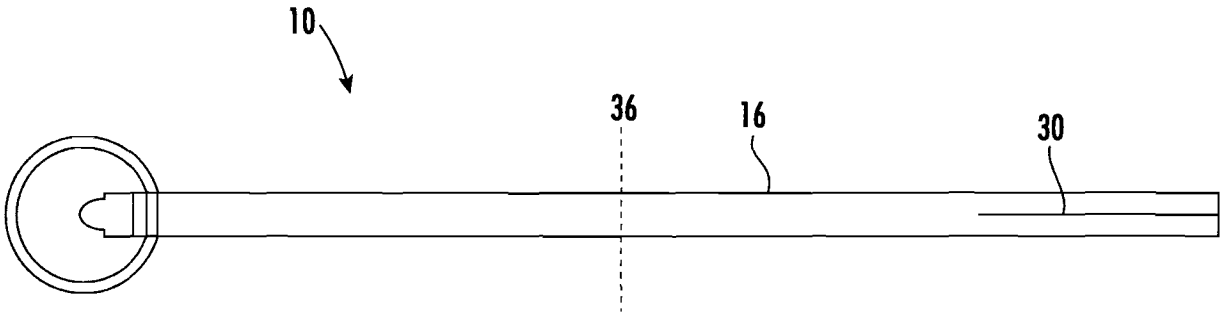
FIG. 6 illustrates the flexible member having a length that is less than 50% of the length of the resistance band.
Figure 7:
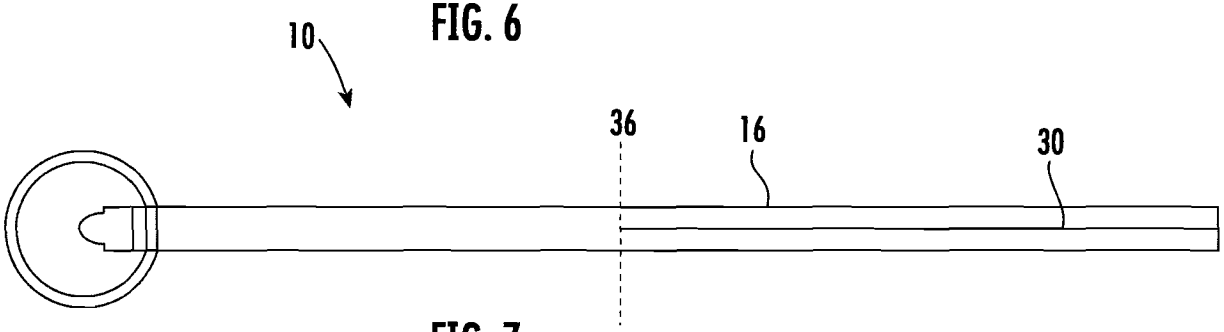
FIG. 7 illustrates the flexible member having a length that is equal to 50% of the length of the resistance band.
Figure 8:
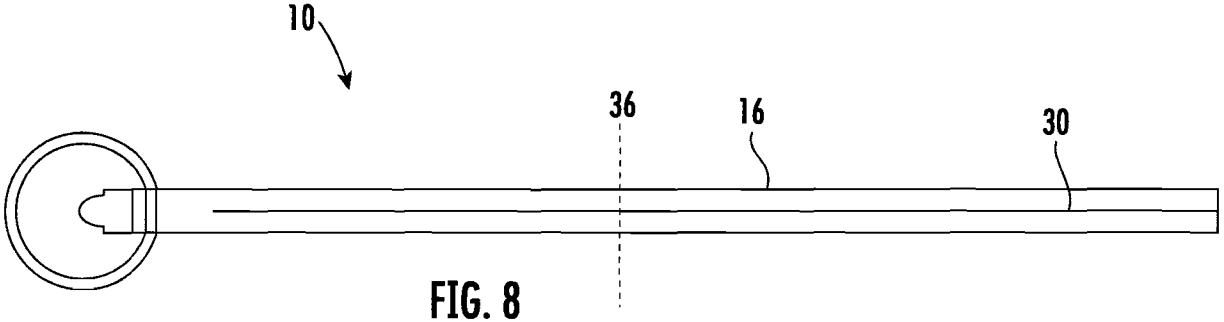
FIG. 8 illustrates the flexible member having a length that is greater than 50% of the length of the resistance band.

FIGS. 6-8 illustrate the flexible member 30 assuming various lengths. FIG. 6 illustrates a flexible member 30 that has a length that is less than half the length of the main body 16 or entire resistance band 10 (dashed line 36 indicating the halfway point of the main body 16 or entire resistance band 10). FIG. 7 illustrates a flexible member 30 that has a length that is the same as half the length of the main body 16 or entire resistance band 10. FIG. 8 illustrates a flexible member 30 that has a length that is greater than half the length of the main body 16 or entire resistance band 10.

Accordingly, the resistance band 10 may be designed to have a flexible member 30 that has a length that is less than 50% of the entire length of the main body 16 or entire resistance band 10, such as 1%-49%. The resistance band 10 may be designed to have a flexible member 30 that is equal to or less than 45% of the entire length of the main body 16 or entire resistance band 10. The resistance band 10 may be designed to have a flexible member 30 that is equal to or less than 40% of the entire length of the main body 16 or entire resistance band 10. The resistance band 10 may be designed to have a flexible member 30 that has a length that is equal to or less than 35% of the entire length of the main body 16 or entire resistance band 10. The resistance band 10 may be designed to have a flexible member 30 that has a length that is equal to or less than 30% of the entire length of the main body 16 or entire resistance band 10. The resistance band 10 may be designed to have a flexible member 30 that is equal to or less than 25% of the entire length of the main body 16 or entire resistance band 10. The resistance band 10 may be designed to have a flexible member 30 that is equal to or less than 20% of the entire length of the main body 16 or entire resistance band 10. The resistance band 10 may be designed to have a flexible member 30 that is equal to or less than 15% of the entire length of the main body 16 or entire resistance band 10. The resistance band 10 may be designed to have a flexible member 30 that is equal to or less than 10% of the entire length of the main body 16 or entire resistance band 10. The resistance band 10 may be designed to have a flexible member 30 that is equal to or less than 5% of the entire length of the main body 16 or entire resistance band 10.

The resistance band 10 may be designed to have a flexible member 30 that has a length that is equal to 50% of the entire length of the main body 16 or entire resistance band 10. The resistance band 10 may be designed to have a flexible member 30 that has a length that is greater than 50% of the entire length of the main body 16 or entire resistance band 10, but less than the length of the entire length of the main body 16 or entire resistance band 10, such as 51%-99%. The resistance band 10 may be designed to have a flexible member 30 that is equal to or greater than 55% of the entire length of the main body 16 or entire resistance band 10. The resistance band 10 may be designed to have a flexible member 30 that is equal to or greater than 60% of the entire length of the main body 16 or entire resistance band 10. The resistance band 10 may be designed to have a flexible member 30 that is equal to greater than 65% of the entire length of the main body 16 or entire resistance band 10. The resistance band 10 may be designed to have a flexible member that is equal to or greater than 70% of the entire length of the main body 16 or entire resistance band 10. The resistance band 10 may be designed to have a flexible member 30 that is equal to or greater than 75% of the entire length of the main body 16 or entire resistance band 10. The resistance band 10 may be designed to have a flexible member 30 that is equal to or greater than 80% of the entire length of the main body 16 or entire resistance band 10. The resistance band 10 may be designed to have a flexible member 30 that is equal to or greater than 85% of the entire length of the main body 16 or entire resistance band 10. The resistance band 10 may be designed to have a flexible member 30 that is equal to or greater than 90% of the entire length of the main body 16 or entire resistance band 10. The resistance band 10 may be designed to have a flexible member 30 that is equal to or greater than 95% of the entire length of the main body 16 or entire resistance band 10.

Figure 9:
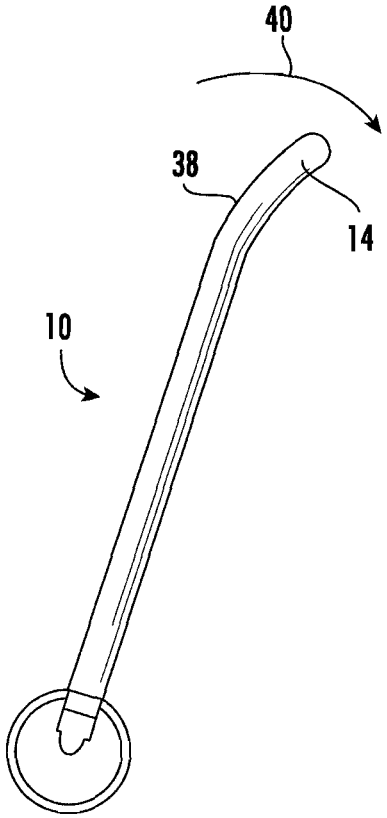
FIG. 9 illustrates the resistance band with force applied thereto.
Figure 10:
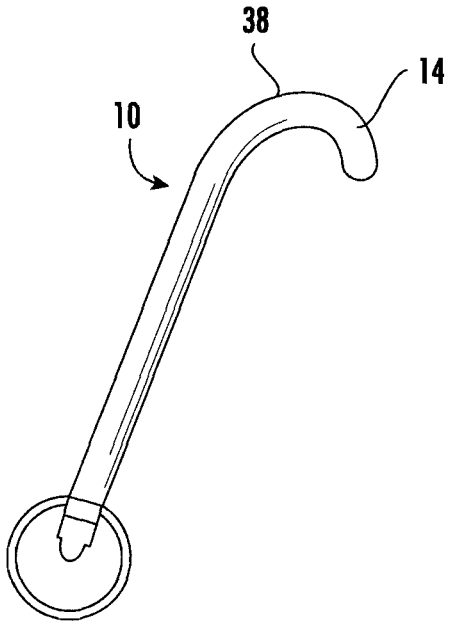
FIG. 10 illustrates the resistance band being bent.
Figure 11:
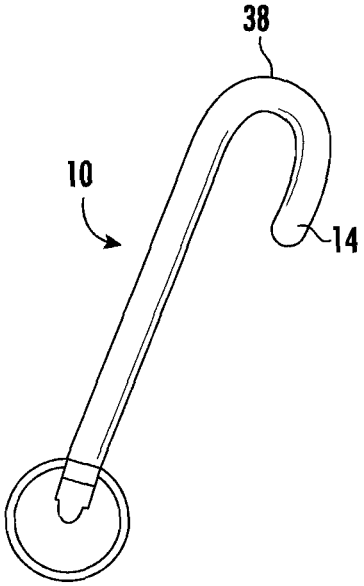
FIG. 11 illustrates the resistance band being bent.
Figure 12:
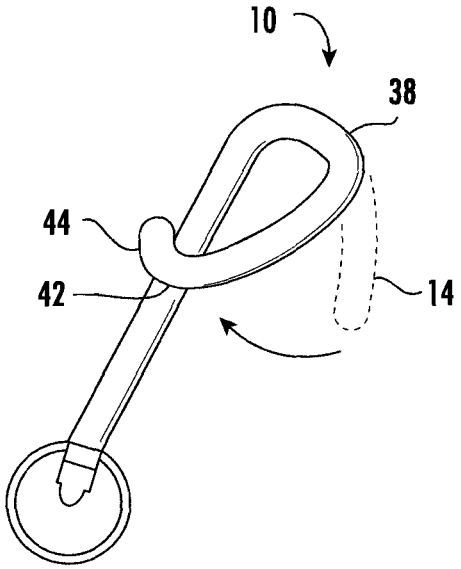
FIG. 12 illustrates the resistance band being bent.

The flexible member 30 is preferably made from a material that can change its shape, but not stretch, when a force is applied, and maintain the changed shape until a second force is applied. Referring to FIG. 9, the resistance band 10 is shown in which the distal end 14 is shoran with a bend 38 resulting from a force applied in the direction of arrow 40. If no force is continuously applied, the distal end 14 of the resistance band 10 maintains its shape. FIGS. 10-12 illustrate the resistance band 10 in which a force is further applied, thereby bending portions of the distal end 14, particularly the attachment portion 34. Any portion of the resistance band 10 which contains the flexible member 30 would therefore be capable of shape manipulation with an applied force. The resistance band 10 is configured for being manipulated at multiple locations to form multiple bends, 38, 42, and 44, see FIG. 12. At any place where a flexible member 30 is positioned, a bend can be created. Preferably, the flexible member 30 is a coated or non-coated copper wire. The copper wire may be, for example, a 10 gauge, 12 gauge, or 14 gauge wire.

Figure 13:
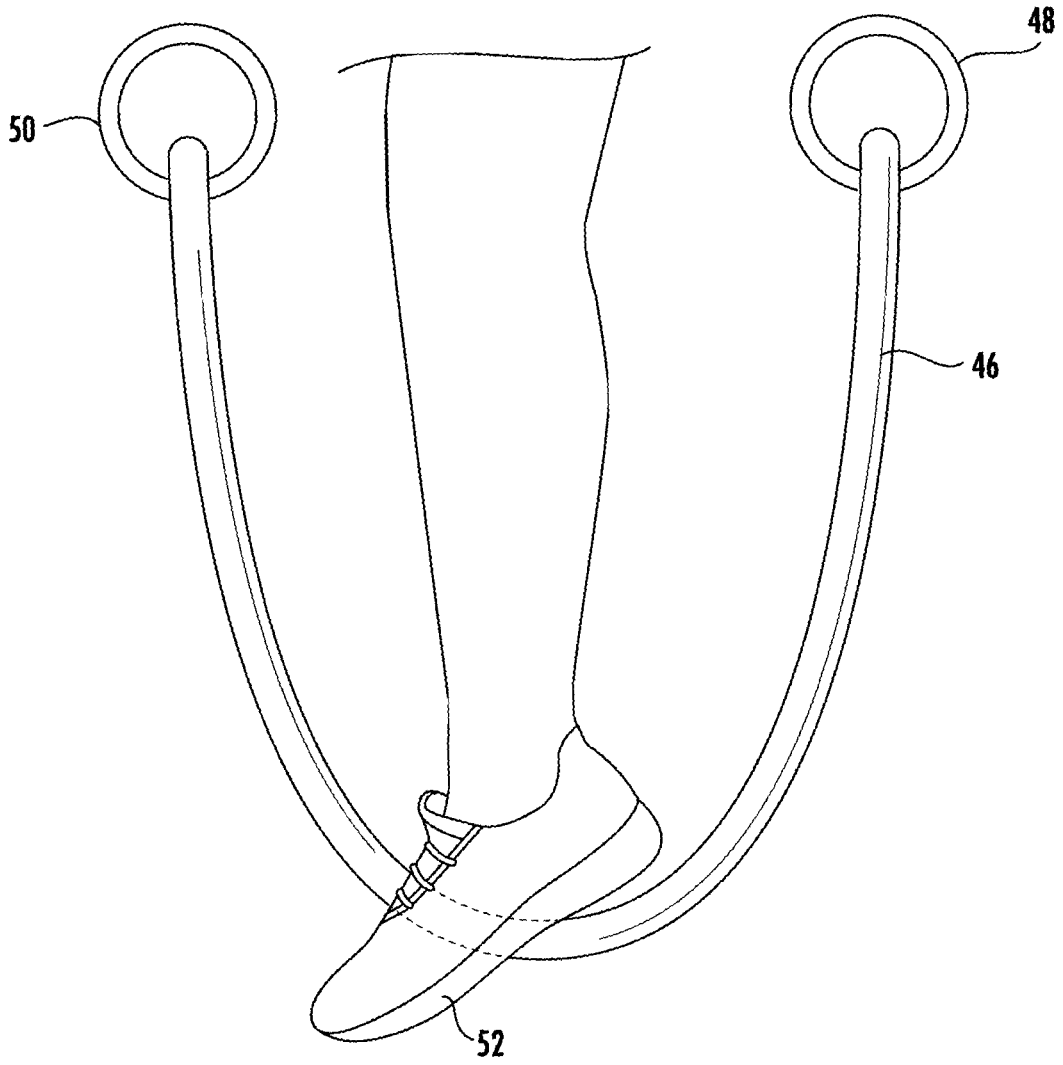
FIG. 13 PRIOR ART
FIG. 13 provides an illustration of a prior art resistance band, illustrating specific attachment means at each end.
Figure 14:
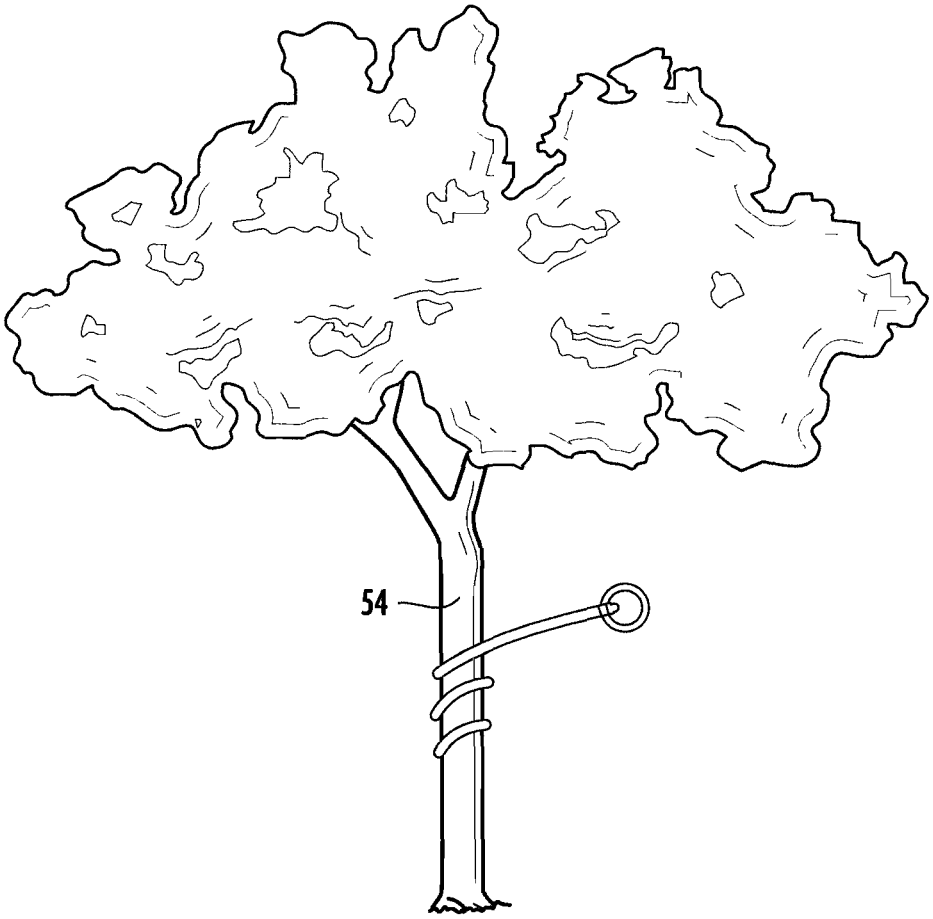
FIG. 14 illustrates the resistance band secured to a tree.
Figure 15A:
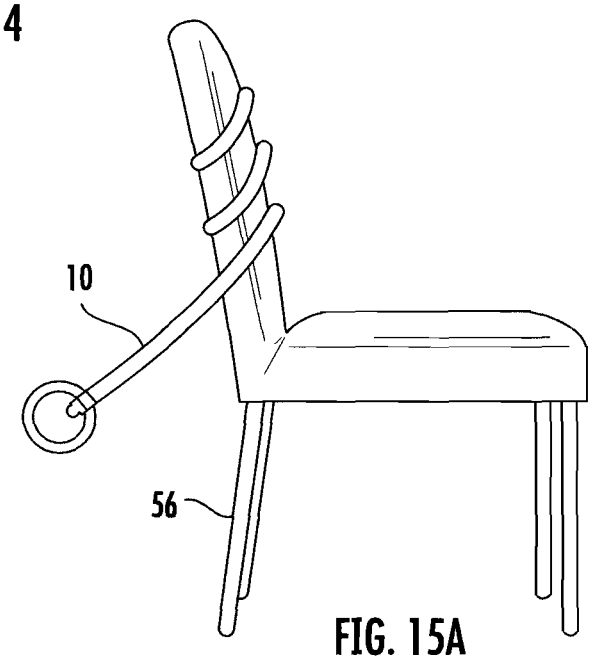
FIG. 15A illustrates the resistance band secured to a chair.
Figure 15B:
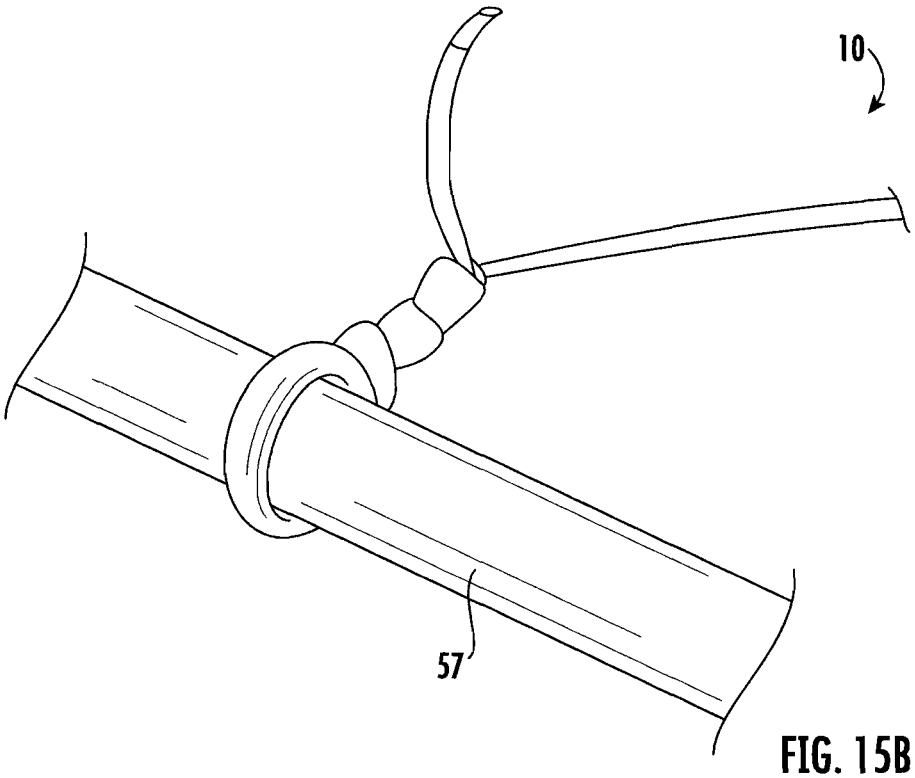
FIG. 15B illustrates the resistance band secured to a post, illustrating a portion of the resistance band secured to or wrapped around another portion of the resistance band.
Figure 16:
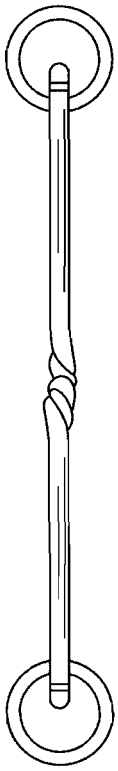
FIG. 16 illustrates multiple resistance bands secured together.
Figure 17:
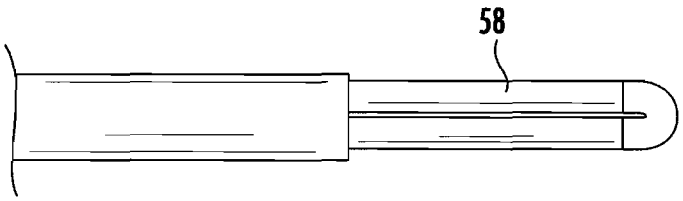
FIG. 17 illustrates the use of a material to maintain the flexible member in place.

The resistance band 10 having a stretchable main body with an inner flexible member 30 provides a better mechanism for the resistance band 10 to be securely wrapped around a fixed object. Such configuration is different than existing resistance bands which include a band 46 with multiple handles 48, 50 attached to the ends, see FIG. 13. In use, the resistance band 46 requires a user to step on the band with a shoe, while pushing up on handles 48, 50. These types of bands, however, fail to allow a means of securing to pre-existing fixed objects like a tree, chair, playground equipment, secure post, vehicle hitch, etc., without removing the handles 48, 50. In contrast, the resistance band 10 can be quickly and easily secured to such objects, see for example, FIG. 14, where the resistance band 10 is wrapped and secured to a tree 54, or FIG. 15A, where the resistance band 10 is wrapped and secured to a portion of a chair 56. By wrapping the resistance band 10 to an object several times or at various positions along the length of the resistance band 10 associated with the flexible member 30, the resistance band 10 can be adjusted for a particular length. FIG. 15B illustrates the resistance band 10 secured to a post 57, illustrating a portion of the resistance band 10 secured being wrapped around or secured to another portion of the resistance band 10. Additionally, two or more resistance bands 10 can be wrapped together, see FIG. 16. This configuration can be secured to an object, thereby increasing resistance.

Figure 18:
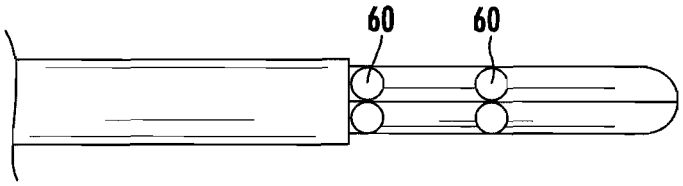
FIG. 18 illustrates the use of a chemical fastening mechanism.

While the resistance band 10 can be made by simply slipping the flexible member 30 into the resistance band main body 16 (coaxially aligned) so the resistance band 10 itself holds to the flexible member 30 (maintaining it in place so it does not move within the interior portion of the resistance band 10), the resistance band 10 can be constructed so the flexible member 30 is held in place by a plastic or foam material 58, or by chemical fastening, such as glue spots 60, see FIG. 18.

All patents and publications mentioned in this specification are indicative of the levels of those skilled in the art to which the invention pertains.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A resistance exercise band comprising:

a resistance band body comprising an elastic material, said resistance band body comprising a first proximal end and second distal end; and an inner flexible member enclosed within an interior region of said resistance band body and positioned at least at said resistance band body distal end and made of a material that maintains its shape until a force is applied to change said shape, said inner flexible member having a length that is less than a length of said outer resistance band body to define a resistance exercise portion and an attachment portion;

said resistance exercise portion defined by a space between an end of said inner flexible member and said first proximal end of said resistance band body which is free of said inner flexible member;

wherein, when a portion of said attachment portion is secured to or engages with an object, said resistance exercise portion is free to stretch independent of said attachment portion.

2. The resistance exercise band according to claim 1 further including a gripping or holding member.

3. The resistance exercise band according to claim 2 wherein said gripping or holding member is a handle secured to said first proximal end.

4. The resistance exercise band according to claim 2 wherein said elastic material is rubber or silicone.

5. The resistance exercise band according to claim 1 wherein said inner flexible member is configured to change its shape, but not stretch, when a force is applied, and maintain said changed shape until a second force is applied.

6. The resistance exercise band according to claim 1 wherein said inner flexible member is a coated or non-coated copper wire.

7. The resistance exercise band according to claim 1 wherein the length of the inner flexible member is less than half the length of said resistance band body.

8. The resistance exercise band according to claim 1 wherein the length of the inner flexible member is equal to 50% the length of said resistance band body.

9. The resistance exercise band according to claim 1 wherein the length of the inner flexible member is greater than 50% the length of said resistance band body.

10. A resistance exercise band comprising:

an outer resistance band made of an elastic material and comprising an inner region and a length; and an inner flexible member enclosed within said inner region of said resistance band body and configured to change its shape, but not stretch, when a force is applied, and maintain said changed shape until a second force is applied and is coaxially aligned with said outer resistance band, said inner flexible member having a length that is less than said length of said outer resistance band, thereby forming a resistance exercise portion and an attachment portion, said resistance exercise portion defined by a space between said inner flexible member and a first proximal end of said outer resistance band which is free of said inner flexible member; wherein, when a portion of said attachment portion is secured to or engages with an object, said resistance exercise portion is free to stretch independent of said secured or engaged attachment portion.

11. The resistance exercise band according to claim 10 further including a gripping or holding member attached to said resistance exercise portion.

12. The resistance exercise band according to claim 11 wherein said gripping or holding member is a handle.

13. The resistance exercise band according to claim 10 wherein said outer resistance band is made from a rubber or silicone material.

14. The resistance exercise band according to claim 10 wherein said inner flexible member is a coated or non-coated copper wire.

15. The resistance exercise band according to claim 10 wherein the length of the inner flexible member is less than half the length of said resistance band body.

16. The resistance exercise band according to claim 10 wherein the length of the inner flexible member is equal to 50% the length of said resistance band body.

17. The resistance exercise band according to claim 10 wherein the length of the inner flexible member is greater than 50% the length of said resistance band body.

* * * * *